US009630232B2

(12) United States Patent
Ishikawa et al.

(10) Patent No.: US 9,630,232 B2
(45) Date of Patent: Apr. 25, 2017

(54) PUNCH OF BLANKING DIE INCLUDING PUNCH AND DIE

(71) Applicant: SHOWA PRECISION TOOLS CO., LTD., Kanagawa (JP)

(72) Inventors: Kenichi Ishikawa, Kanagawa (JP); Norimichi Ebisawa, Kanagawa (JP); Tomonari Hashiguchi, Kanagawa (JP)

(73) Assignee: SHOWA PRECISION TOOLS CO., LTD., Kanagawa (JP)

( * ) Notice: Subject to any disclaimer, the term of this patent is extended or adjusted under 35 U.S.C. 154(b) by 0 days.

(21) Appl. No.: 14/918,767

(22) Filed: Oct. 21, 2015

(65) Prior Publication Data

US 2016/0375479 A1 Dec. 29, 2016

(30) Foreign Application Priority Data

Jun. 29, 2015 (JP) ..... 2015-129804

(51) Int. Cl.
*B21D 28/14* (2006.01)
*B21D 37/20* (2006.01)
*B21D 28/34* (2006.01)

(52) U.S. Cl.
CPC ..... *B21D 28/34* (2013.01); *B21D 37/205* (2013.01)

(58) Field of Classification Search
CPC ..... B21D 28/02; B21D 28/14; B21D 28/246; B21D 28/34; B21D 37/01; B21D 37/02; B21D 37/20; B21D 37/205; B26D 7/26; B26D 7/2614; B26D 2007/2607
USPC ..... 72/325, 326, 327, 329–333, 336–338, 72/464, 481.9, 491.93; 83/681, 682, 685, 83/686, 690, 693.694
See application file for complete search history.

(56) References Cited

U.S. PATENT DOCUMENTS 5,992,285 A * 11/1999 Talarico ..... B21D 28/34 83/684
6,725,756 B2 * 4/2004 Brenneke ..... B21D 28/34 83/697

* cited by examiner

*Primary Examiner* — Peter DungBa Vo
*Assistant Examiner* — Joshua D Anderson
(74) *Attorney, Agent, or Firm* — Nakanishi IP Associates, LLC

(57) ABSTRACT

A punch constitutes, together with a die, a blanking die for punching a workpiece with a punching shape in which protrusions protrude outwards from an annular body. The punch includes a cylinder-shaped punch section and a holder section. In the punch section, a shape of the front end surface corresponding to the punching shape of the workpiece is continuous to a rear end surface, and includes a cutting edge on its front end surface. The holder section is a short cylinder including an inner circumferential surface formed in correspondence with an outer circumferential surface of the punch section to allow insertion of a rear part of the punch section. The protrusions are brought into intimate contact with the recesses of the holder section. A clearance is provided between a part of the punch section other than the protrusions and a part of the holder section other than the recesses.

7 Claims, 7 Drawing Sheets

PUNCH OF BLANKING DIE INCLUDING PUNCH AND DIE

FIELD

Embodiments described herein relate to a punch of a blanking die including the punch and a die.

BACKGROUND

A punch for, for example, the compound stamping forming of a certain component, needs to be equipped with a cutting edge of thin-wall structure, thus, cutting edge portion (a punch section) needs a holder section (flange section) which serves as a pedestal equipped with a mounting part assembled with a die set . Generally, the punch section, when integrally formed with the holder section, needs to be made from a high-hardness material, thus, the holder section integrated with the punch section is inevitably made from the same material with the punch section, thus leading to the high material cost of the punch. The expensive punch needs to be replaced as the cutting edge deteriorates, resulting in the consequent rise in the maintenance cost of the punch machine.

Moreover, as the punch section and the holder section have different shapes from each other, the punch section must be shaped through diesinking electrical discharge machining which requires the use of a dedicated electrode and a dedicated jig, thus, the processing cost is increased, resulting in a further rise in the cost of the punch. The inherent limit of the diesinking electrical discharge machining also restricts a processing precision and a surface smoothness. Further, the long processing time of the diesinking electrical discharge machining is also unavoidable.

BRIEF DESCRIPTION OF THE INVENTION

It is an object of the present invention to shorten the processing time of a punch and improve the processing precision and the surface smoothness of the punch while reducing the material cost, processing cost and maintenance cost of the punch.

The punch according to embodiments of the present invention constitutes, together with a die, a blanking die for punching a workpiece with a punching shape in which a plurality of protrusions protrudes outwards from an annular body. The punch includes a punch section including a cutting edge on a front end surface of the punch section, and a holder section for holding the punch section; the punch section is a cylinder in which a shape of the front end surface corresponding to the punching shape of the workpiece is continuous to a rear end surface; the holder section is a short cylinder including an inner circumferential surface formed in correspondence with an outer circumferential surface of the punch section to allow insertion of a rear part of the punch section; and the protrusions of the punch section are brought into intimate contact with recesses of the holder section, and a clearance is provided between part of the punch section other than the protrusions and part of the holder section other than the recesses so that an adhesive is injected into the clearance to fix the punch section in the holder section.

DETAILED DESCRIPTION OF THE INVENTION

Figure 1:
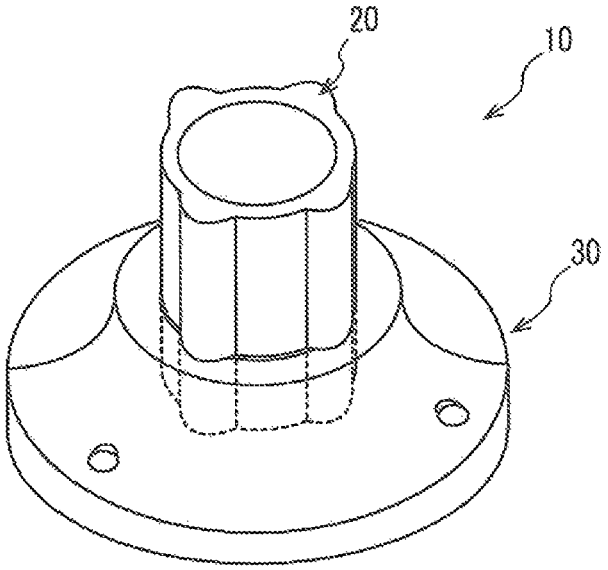
FIG. 1 is a perspective view of a punch according to the present embodiment.
Figure 2:
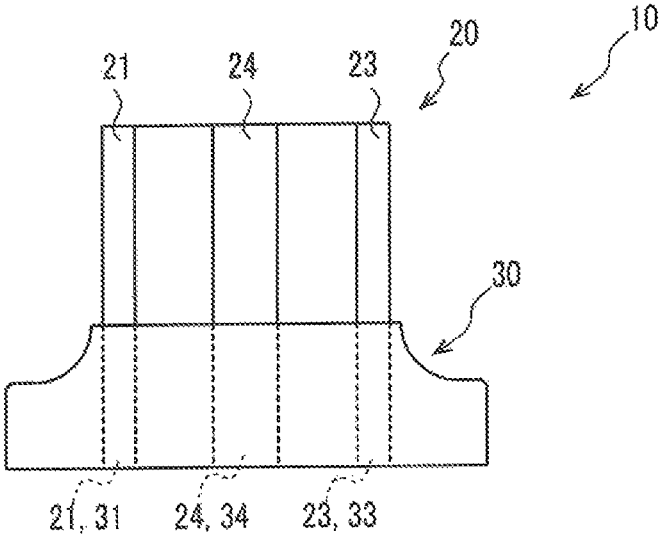
FIG. 2 is a side view of the punch shown in FIG. 1.
Figure 3:
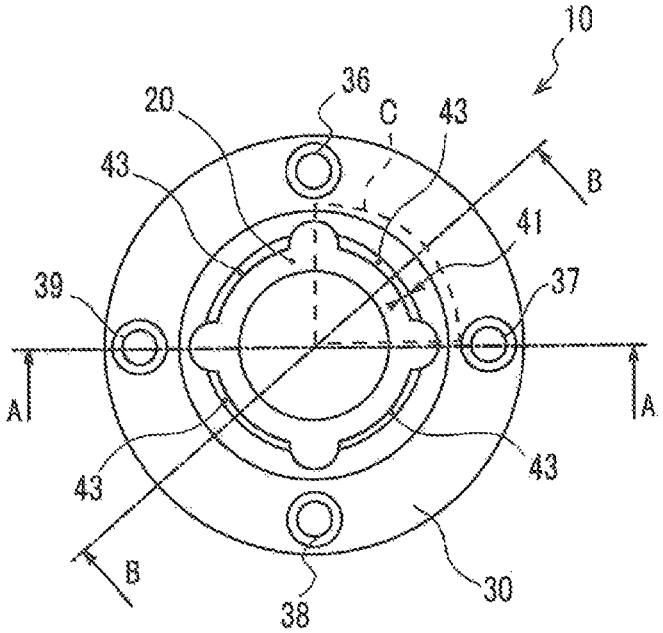
FIG. 3 is a plan view of the punch shown in FIG. 1.
Figure 4:
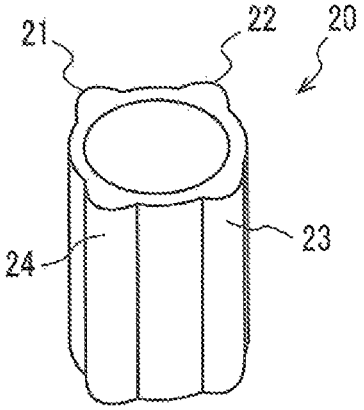
FIG. 4 is a perspective view of a punch section shown in FIG. 1.
Figure 5:
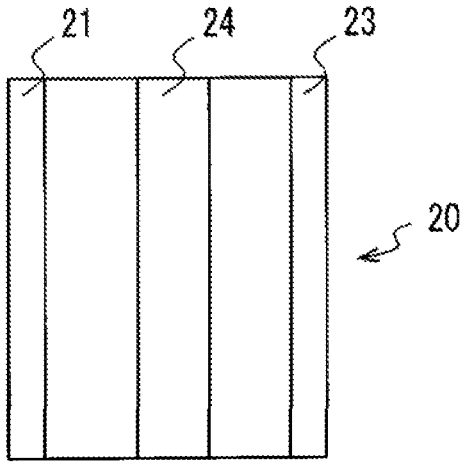
FIG. 5 is a side view of the punch section shown in FIG. 4.
Figure 6:
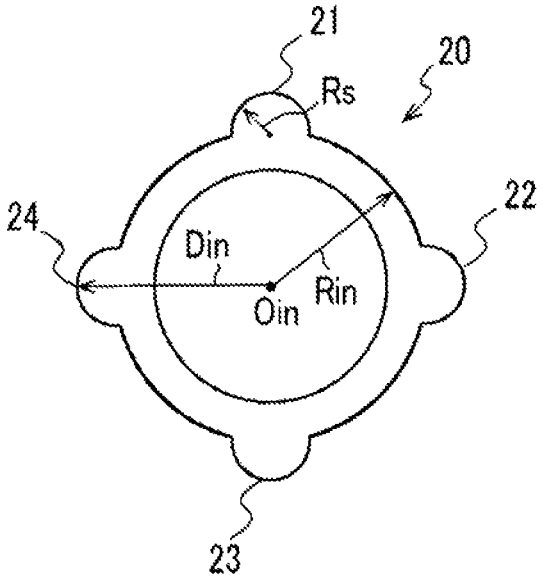
FIG. 6 is a plan view of the punch section shown in FIG. 4.
Figure 7:
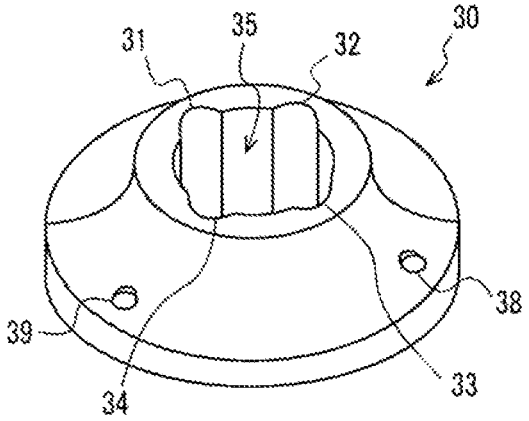
FIG. 7 is a perspective view of a holder section shown in FIG. 1.
Figure 8:
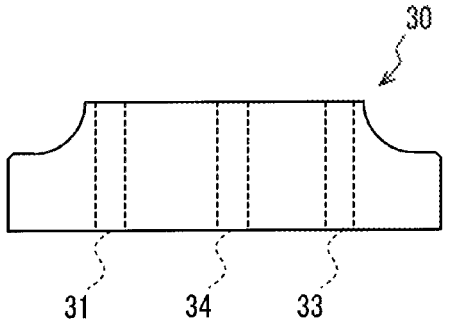
FIG. 8 is a side view of the holder section shown in FIG. 7.
Figure 9:
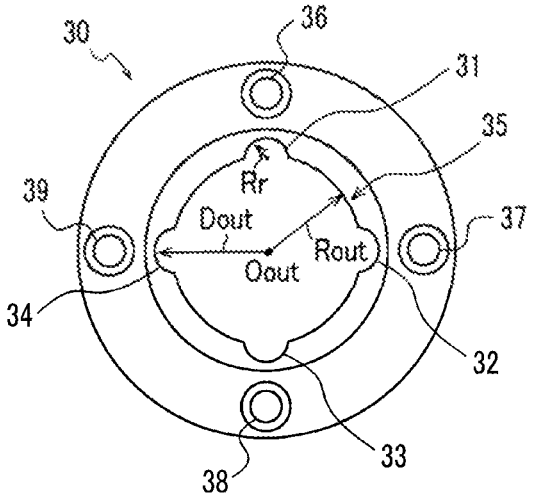
FIG. 9 is a plan view of the holder section shown in FIG. 7.
Figure 10:
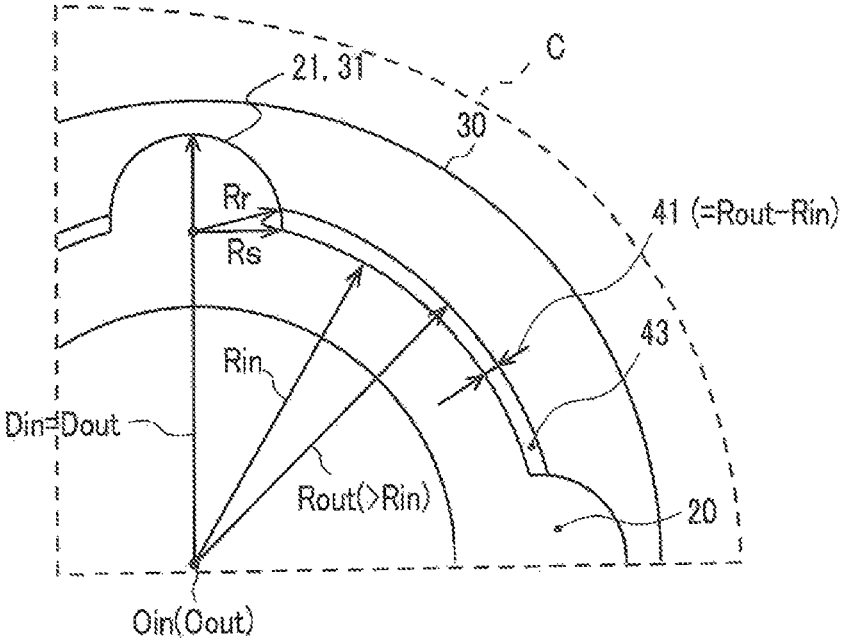
FIG. 10 is an enlarged view of a dotted frame C shown in FIG. 3 and a diagram illustrating a clearance between a punch section and a holder section.
Figure 11:
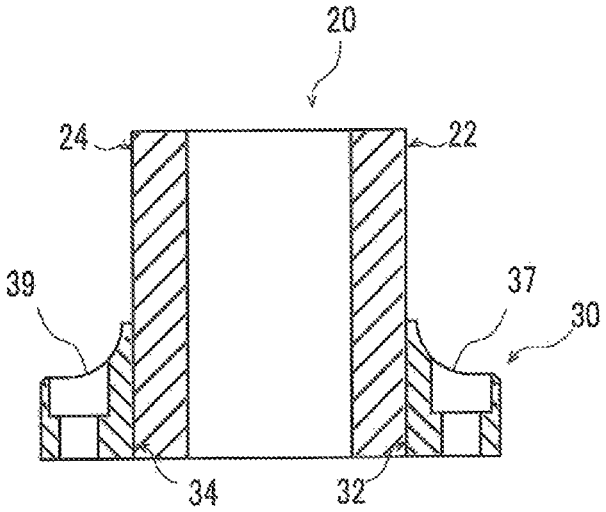
FIG. 11 is a cross-sectional view taken along line A-A shown in FIG. 3.
Figure 12:
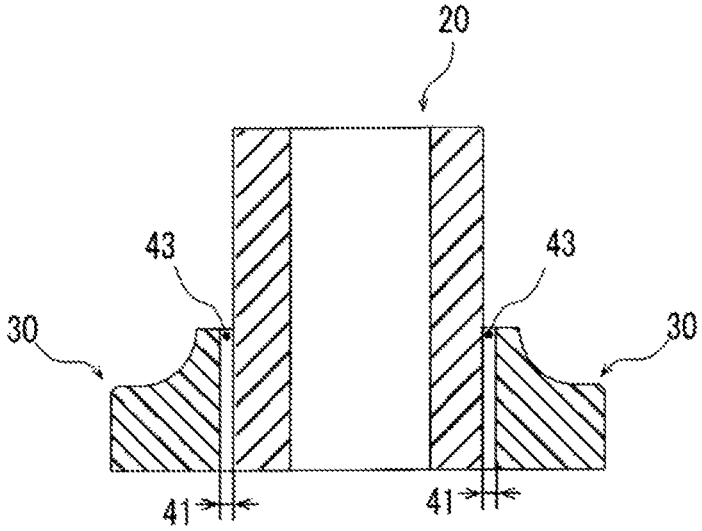
FIG. 12 is a cross-sectional view taken along line B-B shown in FIG. 3.

A punch according to the present embodiment is described below with reference to accompanying drawings. The structural elements having substantially identical functions or structures are hereinafter denoted by identical reference signs, and only necessary repeated descriptions are given.

The punch 10 according to the present embodiment is a punch for a punching process which is used after being mounted on a punch plate of a press machine. The punch 10 is an assembled-type punch including a punch section 20 and a holder section 30 which, for example, may be separately formed using different processing methods. The conventional punch in which the punch section 20 and the holder section 30 are integrally formed is made from an expensive material for the sake of a cutting edge. On the other hand, the punch section 20 and the holder section 30 of an assembled-type punch 10, which are independent from each other, can be made from different materials respectively. Compared with the holder section 30, the punch section 20 is made from a difficult-to-process material or a high-hardness material such as a superhard material, which are relatively high in both cost and hardness. For example, the material of the punch section 20 may be a tool steel. Typically, the punch section 20 is made from an alloy tool steel material (e.g. SKD-11) or a high-speed tool steel material (e.g. SHK-51).

For example, the material of the holder section 30 may be a structural steel or a mechanical structural steel. Typically, the holder section 30 adopts a rolled steel for general structure (e.g. SS400) when it is made from a structural steel and adopts a mechanical structural steel carbon steel (e.g. S45C) when it is made from a mechanical structural steel. Thus, the punch section 20 is made from an expensive material matching with the cutting edge portion, and the holder section 30 is made from a material cheaper than the punch section 20 so as to reduce the material cost of the punch 10 while keeping the intensity of the cutting edge portion of the conventional punch.

Further, each of the punch section 20 and the holder section 30 can be formed into a simple shape by dividing the punch 10 into the punch section 20 and the holder section 30 and then combining them to complete the punch 10. For example, even for a punch which must be produced using a processing method such as diesinking electric discharge machining and the like for the sake of a complicated processing shape as the punch section 20 and the holder section 30 of the punch are integrally formed, separate components can be separately manufactured through wire-cut electrical discharge machining which is higher in processing precision and lower in processing cost than the diesinking electric discharge machining only by dividing the punch, like the punch 10 according to the present embodiment, into separate components (punch section 20 and holder section 30) so that the shapes of the components are simplified.

The punch section 20 is a cylinder. A front end surface of the cylinder is formed according to a punching shape into which the punch section 20, together with the die, punches a workpiece. Herein, the punching shape takes such a shape that a plurality of protrusions protrudes outwards from an annular body. The annular body may be a ring-shaped body, a tetragonal annular body or a polygonal annular body with more than five angles. Herein, a ring-shaped body is described. In this example, the punching shape is a ring-shaped body with four protrusions 21-24 protruding radially outwards from the ring-shaped body. The protrusions 21-24 are formed into a semicircle shape. The four protrusions 21-24 are dispersedly located along the periphery of the ring-shaped body in such a manner that the four protrusions 21-24 meet a point symmetry position relationship with respect to the center of the ring-shaped body. In other words, the four protrusions 21-24 are located on the outer periphery of the ring-shaped body at positions deviated by 90 degrees each.

The punch section 20 is a formed as a cylinder in which the shape of the front end surface is continuous to the rear end surface. In other words, the punch section 20 has a cylinder as a base shape and has, on the outer circumferential surface (lateral side) thereof, protrusion portions which extend along the axial direction of the punch section 20 and have a semicircular cross-section. Being a cylinder, the punch section 20 can be integrally formed from the front end surface to the rear end surface through the wire-cut electrical discharge machining.

Compared with the punch section 20, the holder section 30 is formed into a cylinder (short cylinder) having a longer outer diameter and a shorter axis. The holder section 30 is frustoconical-shaped. The rear portion of the punch section 20 is mounted into a hollow part (through hole) 35 which penetrates the central part of the holder section 30 from the surface of the holder section 30 to the back of the holder section 30. According to the shape of the outer periphery of the front end surface of the punch section 20, the mounting hole of the through hole 35 is formed into a shape which bases on a circle and has semicircular recesses (recesses 31-34) at a plurality of positions, four positions herein, on the circumference thereof. The four semicircular recesses 31-34 are all opened facing the center of the circle. The four recesses 31-34 are dispersedly located along the inner circumference of the through hole 35 in such a manner that the four recesses 31-34 meet a point symmetry position relationship with respect to the center of the through hole 35. In other words, the four recesses 31-34 are located at positions deviated by 90 degrees each on the inner periphery of the through hole 35.

The holder section 30 is formed into a short cylinder including a hollow part 35 (through hole 35) formed by making the shape of the mounting hole thereof extend continuously from the side of the mounting hole to the rear end of the holder section 30. In other words, the holder section 30 has a cylinder as a base shape and has, on the inner circumferential surface thereof, recesses which extend along the axial direction of the holder section to form long grooves and have a semicircular cross-section. Being a cylinder, the holder section 30 can be integrally formed from the front end surface to the rear end surface through wire-cut electrical discharge machining. Further, a plurality of screw holes 36-39 is formed around the mounting hole of the through hole 35 of the holder section 30. The holder section 30 is mounted on the punch plate of a press machine through screws inserted into the holes 36-39. Between the inner circumferential surface of the holder section 30 and the outer circumferential surface of the punch section 20, a clearance is partly, not entirely, formed in a state in which the rear part of the punch section 20 is inserted into the through hole 35 of the holder section 30.

On the cross-section of the punch section 20, the radiuses of the semicircular protrusions 21-24 are set to be Rs, the radius (outer diameter) of the outer edge of the ring-shaped body is set to be Rin, and the distance from the center Oin of the ring-shaped body to the top of each of the protrusions 21-24 is set to be Din (>Rin). On the cross-section of the holder section 30, the radiuses of the semicircular recesses 31-34 are set to be Rr, the distance (inner diameter) from the center Oout of the through hole 35 to the circumference of the through hole 35 is set to be Rout, and the distance from the center Oout of the through hole 35 to the deepest part of each of the recesses 31-34 is set to be Dout (>Rout). The set values are described below. The radius Rr of each of the recesses 31-34 of the holder section 30 is substantially equal to the radius Rs of each of the protrusions 21-24 of the punch section 20. The distance Dout from the center Oout of the through hole 35 of the holder section 30 to the deepest part of each of the recesses 31-34 is equal to the distance Din from the center Oin of the ring-shaped body of the punch section 20 to the top of each of the protrusions 21-24. The inner diameter Rout of the holder section 30 is longer than the outer diameter Rin of the punch section 20 but shorter than the distance Din from the center Oin of the ring-shaped body of the punch section 20 to the top of each of the protrusions 21-24. Preferably, the inner diameter Rout of the holder section 30 is longer than the outer diameter Rin of the punch section 20 by, for example, 1/10 of the radius Rr of each of the recesses 31-34 of the holder section 30.

By designing the dimension of the holder section 30 as described above, in a state in which the rear part of the punch section 20 is inserted into the through hole 35 of the holder section 30, the protrusions 21-24 on the outer circumferential surface of the punch section 20 are brought into intimate contact with the recesses 31-34 on the inner circumferential surface of the holder section 30 and a clearance 41 can be formed between the outer circumferential surface (lateral side) of the punch section 20 excluding the protrusions 21-24 and the inner circumferential surface of the holder section 30 excluding the recesses 31-34. The width of the clearance 41 corresponds to the difference between the outer diameter Rin of the punch section 20 and the inner diameter Rout of the holder section 30. An epoxy-based adhesive 43, which is resinified if cured, is injected into the clearance 41 to solidly fix the punch section 20 in the holder section 30. Further, the radius Rr of each of the recesses 31-34 of the holder section 30 may be a little shorter than the radius Rs of each of the protrusions 21-24 of the punch section 20 so that the punch section 20 is pressed into the through hole 35 of the holder section 30.

The inner circumferential surface of the holder section 30 is designed in such a manner that the recesses 31-34 on the inner circumferential surface of the holder section 30 are entirely brought into intimate contact with the protrusions 21-24 on the outer circumferential surface of the punch section 20 respectively for the correct alignment of the protrusions 21-24 on the outer circumferential surface of the punch section 20 with the recesses 31-34 on the inner circumferential surface of the holder section 30 when the punch section 20 is inserted into the through hole 35 of the holder section 30. In other words, the punch section 20 can be correctly aligned with the holder section 30 when the rear part of the punch section 20 is inserted into the through hole 35 of the holder section 30. In this way, by forming recesses 31-34 corresponding to the protrusions 21-24 on the outer circumferential surface of the punch section 20 on the inner circumferential surface of the holder section 30, the punch section 20 is highly precisely aligned with the holder section 30 in the punch 10 according to the present embodiment.

By forming the inner circumferential surface of the holder section 30 in such a manner that the inner diameter Rout of the holder section 30 is longer than the outer diameter Rin of the punch section 20, a clearance 41 for the injection of the adhesive 43 is provided between the outer circumferential surface of the punch section 20 excluding the protrusions 21-24 and the inner circumferential surface of the holder section 30 excluding the recesses 31-34 so as to guarantee a adhesion area for the adhesion of the inter circumferential surface of the holder section 30 with the outer circumferential surface of the punch section 20. The binding strength between the punch section 20 and the holder section 30, which is related to the adhesion area, is increased as the adhesion area is widened. The assembled punch 10 according to the present embodiment, compared with the conventional punch in which the punch section 20 and the holder section 30 are integrally formed, maybe worse in the binding strength between the holder section 30 and the punch section 20. However, for a processing object such as a thin workpiece, the punch 10 according to the present embodiment can complete a punching process under a relatively small punching pressure, thus guaranteeing a binding strength sufficient to withstand the punching pressure.

In the present embodiment, in order to enable use of wire-cut electrical discharge machining and improve processing efficiency, the punch section 20 and the holder section 30 are both formed into a cylinder. The punch section 20 is bottomless and cannot be structurally held in a pressing direction. The lateral side of punch section 20 needs to be adhered with that of the holder section 30 to guarantee an adequate strength. If the punch section 20 is brought into seamless intimate contact with the holder section 30 without a clearance 41, then a binding strength sufficient to withstand the punching pressure cannot be guaranteed. However, a binding strength sufficient to withstand the punching pressure can be guaranteed by providing the clearance 41, injecting a great amount of resin adhesives 43 therein, curing the resin adhesive 43, and thereby forming a resin layer.

Thus, by use of the concave-convex shape of the external circumferential surface of the punch section 20, the punch 10 according to the present embodiment can achieve both the binding strength and high-precision positioning of the punch section 20 and the holder section 30. The punch 10 according to the present embodiment, which serves as a blanking die together with a die, can also be used like the conventional punch in which the punch section 20 and the holder section 30 are integrally formed.

The punch 10 according to the present embodiment is of an assembled type and is therefore reduced in related material cost. Further, the punch section 20 is formed into a cylinder so as to be axially uniformly shaped according to a punching shape, thus, the punch section 20 can be produced through wire-cut electrical discharge machining. Produced through wire-cut electrical discharge machining, the punch 10 according to the present embodiment is reduced in processing cost, shortened in processing time and endowed with the processing precision and the surface smoothness inherent to wire-cut electrical discharge machining.

Further, if the punch section 20 is a block body, then tap holes can be provided on the punch section 20 to solidly fix the punch section 20 on the holder section 30 via bolts. On the other hand, if the punch section 20 is a thin-walled cylinder, then tap holes are formed in the outer circumferential surface of the punch section 20 for the combination of the punch section 20 with the holder section 30 via bolts, however, damages such as cracks appear from the tap holes on the punch section 20 because of a punching pressure. Thus, the following method is particularly effective in a case where the punch section 20 is a thin-walled cylinder: providing a clearance 41 between the outer circumferential surface of the punch section 20 excluding the protrusions 21-24 and the inner circumferential surface of the holder section 30 excluding the recesses 31-34, like in the assembled punch 10 according to the present embodiment, so that an adequate amount of adhesives 43 can be injected into the clearance 41 to combine the punch section 20 with the holder section 30.

(First Modification)

In the punch 10 according to the present embodiment, the inner circumferential surface of the holder section 30 is designed in such a manner that the protrusions 21-24 on the outer circumferential surface of the punch section 20 are brought into intimate contact with the recesses 31-34 on the inner circumferential surface of the holder section 30 to realize high-precision alignment of the punch section 20 with the holder section 30. However, if the punch section 20 can be highly precisely aligned with the holder section 30, then the dimension of the recesses 31-34 of the holder section 30 is not limited to this. The first modification relates to another dimension of the recesses 31-34 of the holder section 30.

Figure 13:
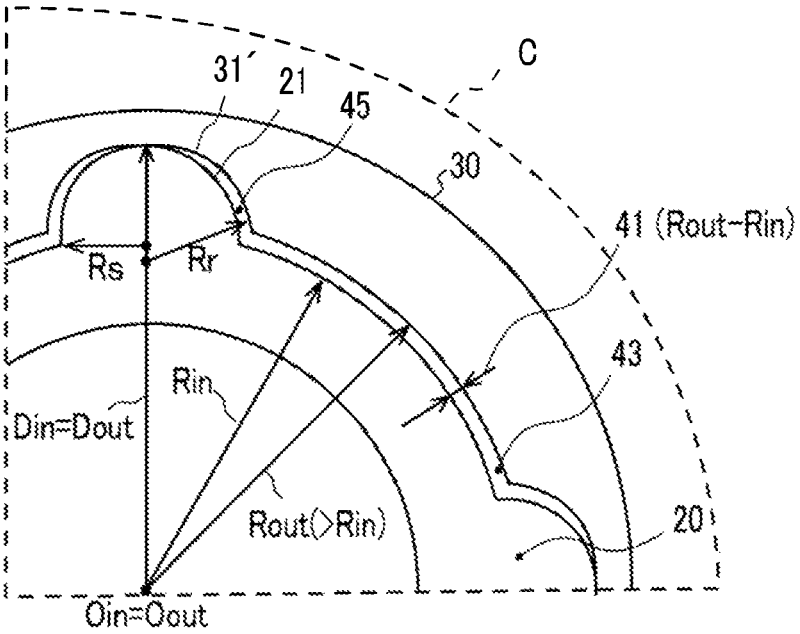
FIG. 13 is a plan view illustrating the dimension of a holder section according to a first modification.

As shown in FIG. 13, the dimension of the holder section 30 according to the first modification is different from that of the holder section 30 according to the above-described embodiment in that the radius Rr of each of recesses 31'-34' of the holder section 30 is longer than the radius Rs of each of the protrusions 21-24 of the punch section 20. By designing the dimension of the holder section 30 like in the first modification, when the rear part of the punch section 20 is inserted into the through hole 35 of the holder section 30, the tops of the protrusions 21-24 on the outer circumferential surface of the punch section 20 abut against the deepest parts of the recesses 31'-34' on the inner circumferential surface of the holder section 30 and clearance 41 is formed between the outer circumferential surface of the punch section 20 excluding the protrusions 21-24 and the inner circumferential surface of the holder section 30 excluding the recesses 31'-34', and clearance 45 is also formed between the outer circumferential surface of each of the protrusions 21-24 on the outer circumferential surface of the punch section 20 excluding the tops of the protrusions and the inner circumferential surface of each of the recesses 31'-34' of the holder section 30 excluding the deepest parts of the recesses.

The inner circumferential surface of the holder section 30 is designed in such a manner that the deepest parts of the recesses 31'-34' on the inner circumferential surface of the holder section 30 abut against the tops of the protrusions 21-24 on the outer circumferential surface of the punch section 20 for the correct alignment of the protrusions 21-24 on the outer circumferential surface of the punch section 20 with the recesses 31'-34' on the inner circumferential surface of the holder section 30 when the punch section 20 is inserted into the through hole 35 of the holder section 30, like in the above-described embodiment.

The inner circumferential surface of the holder section 30 is designed in such a manner that clearances 41 and 45 for the injection of the adhesive 43 are formed between the outer circumferential surface of the punch section 20 excluding the tops of the protrusions 21-24 and the inner circumferential surface of the holder section 30 excluding the deepest parts of the recesses 31'-34', in this way, compared with the punch 10 according to the above-described embodiment, in the first modification, the adhesion area between the lateral side of the punch section 20 and that of the holder section 30 can be widened, thus enabling the punch section 20 to be fixed in the holder section 30 more firmly.

(Second Modification)

In the above-described punch 10, the cross-section of each of the protrusions 21-24 on the outer circumferential surface of the punch section 20 is semicircular. However, in the punch 10 according to the above-described embodiment, the holder section 30 has a cylinder as a base shape and has, on the inner circumferential surface thereof, recesses 31-34 which extend along the axial direction of the holder section 30 to form long grooves and have a semicircular cross-section identical to that of the protrusions 21-24. Thus, the function of the punch 10 according to the above-described embodiment can be achieved without limiting the cross-sectional shape of each of the protrusions 21-24 on the outer circumferential surface of the punch section 20 to the one of the above-described embodiment. The second modification relates to another cross-sectional shape of each of the protrusions 21-24.

Figure 14:
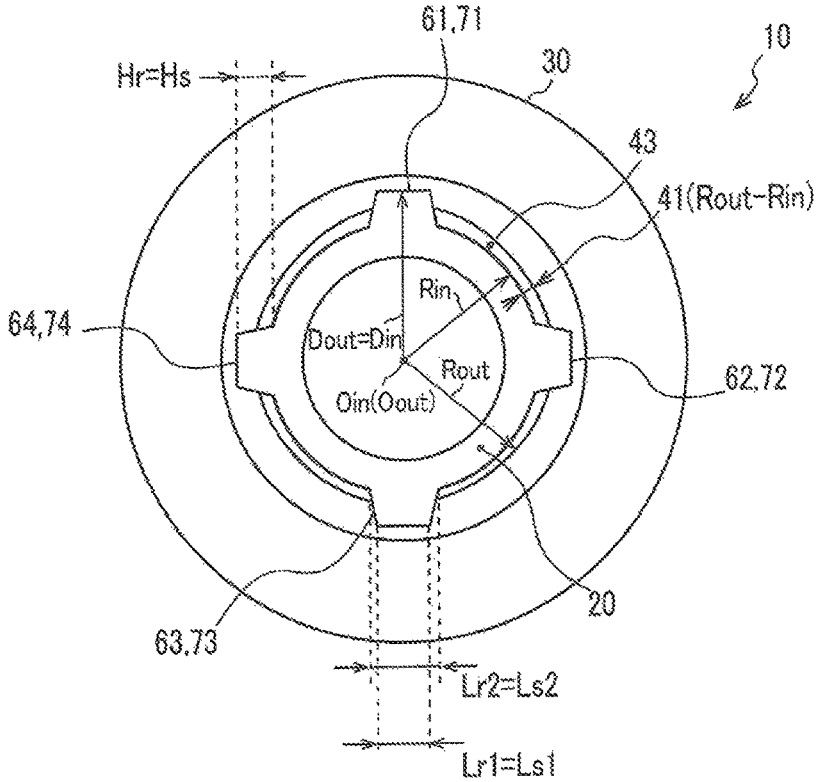
FIG. 14 is a plan view illustrating a punch section and a holder section of a punch according to a second modification.

As shown in FIG. 14, the cross-section of each of the protrusions 61-64 on the outer circumferential surface of the punch section 20 of the punch 10 may be a trapezoid, and typically, an isosceles trapezoid. The long groove recesses 71-74 with an isosceles trapezoid-shaped cross-section are formed on the inner circumferential surface of the holder section 30 along the axial direction of the holder section in correspondence with the shape of each of the protrusions 61-64 on the outer circumferential surface of the punch section 20.

As stated above, each of the protrusions 61-64 has an isosceles trapezoid-shaped cross-section, and the length of the upper bottom thereof is represented by Ls1, the length of the lower bottom thereof is represented by Ls2, and the height thereof is represented by Hs. Further, the distance from the center Oin of the ring-shaped body to the top of each of the protrusions 61-64 is represented by Din (>Rin). The outer diameter of the ring-shaped body of the punch section 20 is represented by Rin. Similarly, the recesses 71-74 of the holder section 30 also have an isosceles trapezoid-shaped cross-section, and the length of the upper bottom of the isosceles trapezoid-shaped cross-section is represented by Lr1, the length of the lower bottom of the isosceles trapezoid-shaped cross-section is represented by Lr2, and the height of the isosceles trapezoid-shaped cross-section is represented by Hr. Further, the distance from the center Oout of the through hole 35 to the deepest part of each of the recesses 71-74 is represented by Dout (>Rout). The distance (inner diameter) from the center Oout of the through hole 35 of the holder section 30 to the inner circumferential surface of the circumference part excluding the recessions 71-74 is represented by Rout.

The length Lr1 of the upper bottom of each of the recesses 71-74 of the holder section 30 is substantially equal to the length Ls1 of the upper bottom of each of the protrusions 61-64 of the punch section 20. The length Lr2 of the lower bottom of each of the recesses 71-74 of the holder section 30 is substantially equal to the length Ls2 of the lower bottom of each of the protrusions 61-64 of the punch section 20. The height Hr of the holder section 30 is substantially equal to the height Hs of the punch section 20. The distance Dout from the center Oout of the through hole 35 of the holder section 30 to the deepest part of each of the recesses 71-74 is equal to the distance Din from the center Oin of the ring-shaped body of the punch section 20 to the top of each of the protrusions 61-64. The inner diameter Rout of the holder section 30 is longer than the outer diameter Rin of the punch section 20 but shorter than the distance Din from the center Oin of the ring-shaped body of the punch section 20 to the top of each of the protrusions 61-64. Preferably, the inner diameter Rout of the holder section 30 is longer than the outer diameter Rin of the punch section 20 by, for example, 1/10 of the radius Rr of each of the recesses 71-74 of the holder section 30.

Since the dimension of the holder section 30 is designed as stated above, when the rear part of the punch section 20 is inserted into the through hole 35 of the holder section 30, the entire protrusions 61-64 on the outer circumferential surface of the punch section 20 are brought into intimate contact with the recesses 71-74 on the inner circumferential surface of the holder section 30 and a clearance 41 can be formed between the outer circumferential surface of the punch section 20 excluding the protrusions 61-64 and the inner circumferential surface of the holder section 30 excluding the recesses 71-74. An epoxy-based adhesive 43, which is resinified if cured, is injected into the clearance 41 to firmly fix the punch section 20 in the holder section 30. Further, for example, by making the height Hr of each of the recesses 71-74 of the holder section 30 a little shorter than the height Hs of each of the protrusions 21-24 of the punch section 20, the recesses 71-74 of the holder section 30 may be made a little smaller than the protrusions 21-24 of the punch section 20 so that the punch section 20 can be pressed into the through hole 35 of the holder section 30. In this way, the punch 10 according to the second modification can achieve the same effect with the punch 10 according to the above-described embodiment.

(Third Modification)

In the punch 10 according to the second modification, the inner circumferential surface of the holder section 30 is designed in such a manner that the entire protrusions 61-64 on the outer circumferential surface of the punch section 20 are brought into intimate contact with the recesses 71-74 on the inner circumferential surface of the holder section 30 to realize high-precision alignment of the punch section 20 with the holder section 30. However, if the punch section 20 can be highly precisely aligned with the holder section 30, then the dimension of the recesses 71-74 of the holder section 30 is not limited to this. The third modification relates to another dimension of the recesses 71-74 of the holder section 30.

Figure 15:
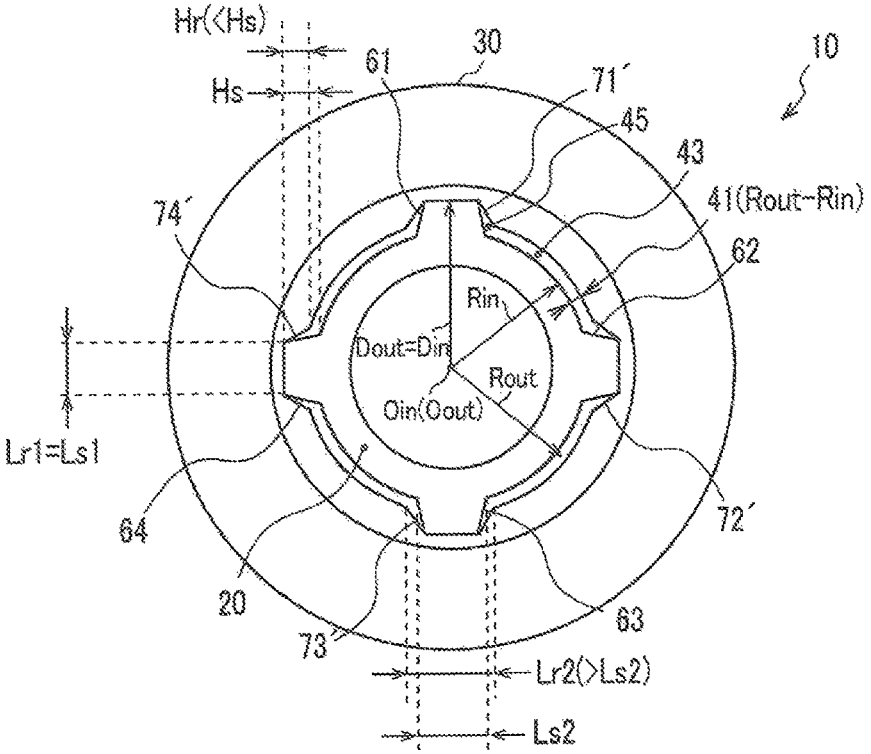
FIG. 15 is a plan view illustrating a punch section and a holder section of a punch according to a third modification.

As shown in FIG. 15, the dimension of the holder section 30 according to the third modification is different from that of the holder section 30 according to the second modification in that the height Hr of each of the recesses 71'-74' of the holder section 30 is smaller than the height Hs of each of the protrusions 61-64 of the punch section 20 and that the length Lr2 of the lower bottom of each of the recesses 71'-74' of the holder section 30 is greater than the length Ls2 of the lower bottom of each of the protrusions 61-64 of the punch section 20. More specifically, the height Hr of each of the recesses 71'-74' of the holder section 30 is lower than the height Hs of each of the protrusions 61-64 of the punch section 20 by, for example, ⅔ of height Hs, and the length Lr2 of the lower bottom of each of the recesses 71'-74' of the holder section 30 is longer than the length Ls2 of the lower bottom of each of the protrusions 61-64 of the punch section 20 by, for example, ⅕ of length Ls2.

By shaping the recesses 71'-74'of the holder section 30 like in the third modification, the tops of the protrusions 61-64 on the outer circumferential surface of the punch section 20 abut against the deepest parts of the recesses 71'-74' on the inner circumferential surface of the holder section 30 and clearance 41 is formed between the outer circumferential surface of the punch section 20 excluding the protrusions 61-64 and the inner circumferential surface of the holder section 30 excluding the recesses 71'-74' when the rear part of the punch section 20 is inserted into the through hole 35 of the holder section 30, and clearance 45 can also be formed between the outer circumferential surface of each of the protrusions 61-64 on the outer circumferential surface of the punch section 20 excluding the tops of the protrusions and the inner circumferential surface of each of the recesses 71'-74' of the holder section 30 excluding the deepest parts of the recesses. An epoxy-based adhesive 43, which is resinified if cured, is injected into the clearances 41 and 45 to firmly fix the punch section 20 in the holder section 30. Thus, the punch 10 according to the third modification can achieve the same effect with the punch 10 according to the first embodiment.

While certain embodiments of the present invention have been described, these embodiments have been presented by way of example only, and are not intended to limit the scope of the present invention. Indeed, the novel embodiments may be embodied in a variety of other forms; furthermore, various omissions, substitutes and variations thereof may be devised without departing from the spirit of the present invention. The accompanying claims and their equivalents are intended to cover such forms and modifications as would fall within the scope and spirit of the present invention.

DESCRIPTION OF REFERENCE NUMERALS

10 Punch 20 Punch section 21-24 Protrusions 30 Holder section 31-34 Recesses 35 Through hole 36-39 Screw holes 41 Clearance 43 Adhesive

What is claimed is:

1. A punch constituting, together with a die, a blanking die for punching a workpiece with a punching shape in which a plurality of protrusions protrude outwards from an annular body, wherein the punch includes a punch section including a cutting edge on a front end surface of the punch section, and a holder section for holding the punch section;

the punch section is a cylinder in which a shape of the front end surface corresponding to the punching shape of the workpiece is continuous to a rear end surface;

the holder section is a short cylinder including an inner circumferential surface formed in correspondence with an outer circumferential surface of the punch section to allow insertion of a rear part of the punch section;

tops of protrusions of the punch section are brought into intimate contact with recesses of the holder section, and a clearance is provided between part of the punch section other than the protrusions and part of the holder section other than the recesses so that an adhesive is injected into the clearance to fix the punch section in the holder section;

the protrusions of the punch section and the recesses of the holder section are each arc-shaped; and the radius of each of the recesses of the holder section is longer than the radius of each of the protrusions of the punch section, and the adhesive is injected into a clearance formed on a lower end part between the recesses of the holder section and the protrusions of the punch section.

2. The punch according to claim 1, wherein the holder section is made from a material different from that of the punch section.

3. The punch according to claim 1, wherein the punch section is made from a tool steel; and the holder section is made from a structural steel or a mechanical structural steel.

4. The punch according to claim 1, wherein the punch section is integrally formed from the front end surface to the rear end surface through wire-cut electrical discharge machining.

5. The punch according to claim 1, wherein the adhesive is an epoxy-based adhesive.

6. The punch according to claim 1, wherein an inner diameter of the part of the holder section other than the recesses is longer than an outer diameter of the part of the punch section other than the protrusions.

7. A punch constituting, together with a die, a blanking die for punching a workpiece with a punching shape in which a plurality of protrusions protrude outwards from an annular body, wherein the punch includes a punch section including a cutting edge on a front end surface of the punch section, and a holder section for holding the punch section;

the punch section is a cylinder in which a shape of the front end surface corresponding to the punching shape of the workpiece is continuous to a rear end surface;

the holder section is a short cylinder including an inner circumferential surface formed in correspondence with an outer circumferential surface of the punch section to allow insertion of a rear part of the punch section;

tops of protrusions of the punch section are brought into intimate contact with recesses of the holder section, and a clearance is provided between part of the punch section other than the protrusions and part of the holder section other than the recesses so that an adhesive is injected into the clearance to fix the punch section in the holder section;

the protrusions of the punch section and the recesses of the holder section are each trapezoid-shape; and the protrusions of the punch section and the recesses of the holder section each take an isosceles trapezoid shape, an upper bottom of each of the recesses of the holder section is as long as an upper bottom of each of the protrusions of the punch section, a lower bottom of each of the recesses of the holder section is longer than a lower bottom of each of the protrusions of the punch section, the upper bottom of each of the protrusions of the punch section abuts against the upper bottom of each of the recesses of the holder section, and the adhesive is injected into a clearance formed on a lower bottom side between the protrusions of the punch section and the recesses of the holder section.

* * * * *